US009163183B2

(12) United States Patent
Havlik

(10) Patent No.: US 9,163,183 B2
(45) Date of Patent: Oct. 20, 2015

(54) REMOVAL OF SOLUBILIZED METALS FROM FISCHER-TROPSCH PRODUCTS

(71) Applicant: REG SYNTHETIC FUELS, LLC, Ames, IA (US)

(72) Inventor: Peter Havlik, Tulsa, OK (US)

(73) Assignee: REG SYNTHETIC FUELS, LLC, Ames, IA (US)

( * ) Notice: Subject to any disclaimer, the term of this patent is extended or adjusted under 35 U.S.C. 154(b) by 22 days.

(21) Appl. No.: 13/683,181

(22) Filed: Nov. 21, 2012

(65) Prior Publication Data

US 2014/0138283 A1 May 22, 2014

(51) Int. Cl.

| | |
|---|---|
| ***C10G 17/02*** | (2006.01) |
| ***C10G 17/04*** | (2006.01) |
| ***C10G 21/16*** | (2006.01) |
| ***C10G 25/00*** | (2006.01) |
| ***C10G 45/00*** | (2006.01) |
| ***C10G 45/58*** | (2006.01) |
| ***C10G 53/04*** | (2006.01) |
| ***C10G 53/08*** | (2006.01) |
| ***C10G 53/10*** | (2006.01) |
| ***C10G 67/04*** | (2006.01) |
| ***C10G 67/06*** | (2006.01) |
| ***C10G 67/08*** | (2006.01) |

(Continued)

(52) U.S. Cl.

CPC ..... *C10G 17/04* (2013.01); *C10G 21/00* (2013.01); *C10G 21/16* (2013.01); *C10G 25/00* (2013.01); *C10G 45/00* (2013.01); *C10G 45/58* (2013.01); *C10G 53/04* (2013.01); *C10G 53/08* (2013.01); *C10G 53/10* (2013.01); *C10G 67/04* (2013.01); *C10G 67/06* (2013.01); *C10G 67/08* (2013.01); *C10G 2300/1022* (2013.01); *C10G 2300/202* (2013.01); *C10G 2300/205* (2013.01)

(58) Field of Classification Search

CPC ..... C10G 17/02; C10G 17/04; C10G 21/16; C10G 21/20; C10G 21/24; C10G 53/00; C10G 53/04; C10G 53/10

USPC ..... 518/709–710; 210/4, 5, 155; 502/20–22, 24, 28–29

See application file for complete search history.

(56) References Cited

U.S. PATENT DOCUMENTS 6,194,625 B1 * 2/2001 Graves et al. ..... 585/313
6,476,086 B1 11/2002 Zhou (Continued)

FOREIGN PATENT DOCUMENTS

EP 0 195 991 A2 10/1986

OTHER PUBLICATIONS

"The 2001 Mixing, Blending and Size Reduction Handbook," Processing (Mar. 2001), 8 pages, available at http://www.admix.com/pdfs/resourcelibrary-tech-mixhandbook.pdf.

(Continued)

*Primary Examiner* — Brian McCaig

(74) *Attorney, Agent, or Firm* — Foley & Lardner LLP; James P. McParland; Joseph P. Meara

(57) ABSTRACT

The present disclosure is directed to a method and system of removing solubilized metals from a Fischer-Tropsch (FT) reactor product. The FT reactor product is contacted with a chelating agent to form metal complexes. The FT reactor product containing metal complexes are subjected to centrifugal separation to form a heavy phase and a light phase containing less than 500 wppb solubilized metals.

28 Claims, 2 Drawing Sheets

(51) Int. Cl.

| | |
|---|---|
| ***C10G 21/00*** | (2006.01) |
| *C10G 21/20* | (2006.01) |
| *C10G 21/24* | (2006.01) |

(56) References Cited

U.S. PATENT DOCUMENTS

| | | | | |
|---|---|---|---|---|
| 7,488,760 | B2 | 2/2009 | Vogel | |
| 8,022,108 | B2 | 9/2011 | Bull et al. | |
| 2005/0004239 | A1* | 1/2005 | Bull et al. | 518/726 |
| 2007/0197667 | A1* | 8/2007 | Vogel | 518/700 |
| 2010/0249485 | A1* | 9/2010 | Mdleleni et al. | 585/858 |

OTHER PUBLICATIONS

Zhang, et al., "High shear mixers: A review of typical applications and studies on power draw, flow pattern, energy dissipation and transfer properties," Chemical Engineering and Processing, 57-58 (2012), pp. 25-41.

J. Johnson, et al. "Emissions from Fischer-Tropsch Diesel Fuels" SAE Technical Paper 2001-01-3518 (published Sep. 24, 2001) ("SAE 2001").

L.G. Huve "Shell Global Solutions Dewaxing Technologies & Catalysts Current Status" pp. 1-13., 2007.

* cited by examiner

REMOVAL OF SOLUBILIZED METALS FROM FISCHER-TROPSCH PRODUCTS

CROSS-REFERENCE TO RELATED APPLICATIONS

Not applicable.

STATEMENT REGARDING FEDERALLY SPONSORED RESEARCH OR DEVELOPMENT

Not applicable.

One embodiment of the present disclosure relates generally to the field of synthetic hydrocarbons. More particularly, one embodiment of the present disclosure relates to the conversion of low value carbonaceous feedstock to higher value fuels, specialty fluids, solvents, waxes, and other chemicals via Fischer-Tropsch (Fr) conversion. Still more particularly, one embodiment of the present disclosure relates to the removal of catalyst fines from the FT reaction product streams.

BACKGROUND

The FT process involves conversion of syngas (a gas composition including CO and $H_2$ formed by partial oxidation or steam reforming of carbonaceous matter) to liquid hydrocarbons suitable for use as motor fuels. There are also applications as jet fuel, lubricants and wax. The process was developed in 1920's Germany and scaled up using fixed-bed reactor designs. However, the technology found broadest use and capacity expansions in South Africa from the 1950's through the 1980's. In addition to the fixed-bed process, an iron-catalyzed fluid-bed reactor system was developed to make mainly gasoline. The feedstock to both the German and the South African FT plants was coal, gasified using similar types of gasifier (the so-called Lurgi gasifier).

In the 1980's and 1990's, international oil companies such as Shell and Exxon looked at FT conversion as a means to monetize remote natural gas fields. As part of these gas to liquids (GTL) endeavors, a new generation of highly active cobalt FT catalysts was developed that enabled lower temperature syngas conversion conditions, and consequently, a much better quality paraffinic product for diesel, jet fuel, and linear alkyl benzene (LAB) production.

With the lower temperature operating conditions, an alternate reactor technology was adopted—the slurry bubble column. Compared to multi-tube fixed-bed reactors, slurry reactors have the advantage of higher heat removal efficiencies, ease of catalyst addition and withdrawal (without need for reactor shutdown), and lower capital costs. However, unlike the fluid-bed and fixed-bed processes, the catalyst needs to be filtered out of the slurry reactor's liquid product. The churn-turbulent hydrodynamic regime, under which slurry bubble column reactors operate, result in catalyst attrition profiles that include nanometer size catalyst fines either suspended and/or solubilized within the FT syncrude composition matrix. As a result, traditional solid-liquid separation techniques, such as filtration and settling/sedimentation, are only partially effective. The catalyst metal fines that are not removed after filtration are also referred to as "solubilized metals." (FT syncrude may contain oxygenates such as alcohols, aldehydes, ketones, and carboxylic acids in addition to hydrocarbons. These oxygenates, in particular carboxylic acids, are generally considered undesirable byproducts of FT fuel production since they cause corrosion issues in the process plant, and if not removed, in the fuel product.)

FT continues to be investigated for converting abundant and low cost hydrocarbon resources into high quality synthetic fuels, waxes, and specialty fluids. Recent advances in hydraulic fracturing and production of shale gas in the U.S. at a time of generally high global crude oil prices, has made the economics of gas to liquid (GTL) via FT conversion particularly attractive.

Gasification of biomass into syngas for subsequent FT conversion, the so-called biomass-to-liquid (BTL) process, has also been recognized as among the most sustainable fuel production platforms. The woody biomass feedstock for BTL processes includes, for example, but is not limited to switch grass, woodchips, various paper mill waste streams, and even municipal waste.

There is, thus, a need to develop new and more effective and efficient methods and systems for separation of ultra-fine catalyst particulates and solubilized metals from FT reaction products, and promote the wider deployment of the relatively low capital cost FT slurry reactor processes.

There remains a need for milder, less energy-intensive, and yet more effective methods and systems for removal of solubilized metals and ultra-fine particulates from FT reactor product streams of which one embodiment of the present disclosure is directed.

SUMMARY

One embodiment of the present disclosure includes methods and systems for removing solubilized metals and ultra-fine particulates from FT products. In various embodiments of the present disclosure, these contaminants are removed from the FT product. The FT product or fraction thereof is contacted with a chelating agent to form metal complex(es).

The FT product containing the metal complexes is subjected to centrifugal separation to form a light phase and a heavy phase.

The light phase is contacted with adsorbent media and/or filtration aids.

The adsorbent media and/or filtration aids from the light phase are separated to yield a treated FT product containing less than 500 wppb (part per billion by weight) solubilized metals.

An advantage of one embodiment of the present methods and systems is that the treated FT product is of a quality that can optionally be fractionated into fuel cuts without hydroprocessing, or achieve superior hydroprocessing performance due to substantial absence of solubilized metals and other contaminants.

DETAILED DESCRIPTION

One embodiment of the present disclosure is described in terms of a conventional FT reactor product sent for refining or product upgrading. Refining or product upgrading typically includes hydroprocessing (e.g. hydrotreating, hydrocracking and/or hydroisomerizing) and/or fractionation (e.g. conventional distillation, vacuum distillation, and/or wiped-film evaporator systems). However, it should be understood that one embodiment of the present disclosure is not limited to FT reactor products. That is, one embodiment of the present disclosure may include systems involving syngas and slurry phase conversion reactors.

Conventional slurry FT reactors are typically equipped with a filter, internal or external to the reactor, wherein the catalyst is continuously separated and returned to the reactor. In some embodiments, the filter is a component of a separation system comprising a hydrocyclone, a filter, and a settler. The filters are typically equipped with wire-mesh or sintered metal elements. However, the filtrate (FT reactor product) contains about 1 wppm (part per million by weight) to about 100 wppm ultra-fine catalyst particulates. These are typically about 10 nanometer to about 1000 nanometer in size, and exist at least partly, as a colloidal suspension and/or solubilized metal constituents. It is possible to concentrate the FT fines into a heavier boiling range cut by distilling off the lighter hydrocarbon components.

Figure 1:
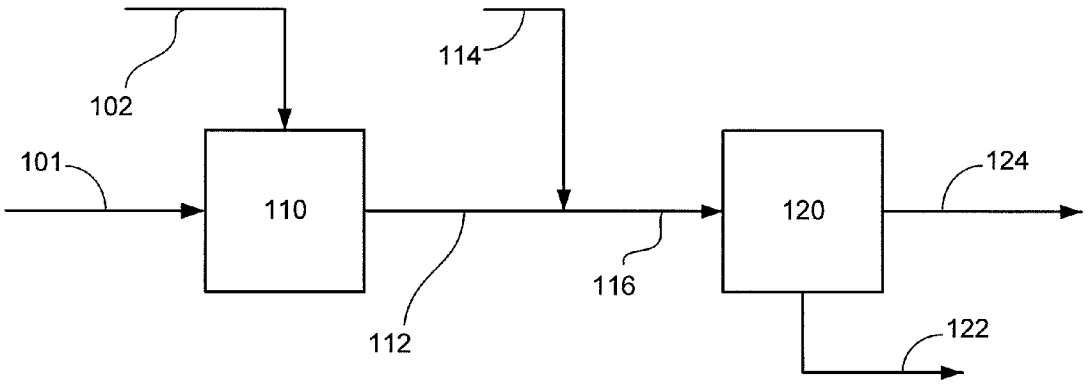
FIG. 1 is a schematic flow diagram of one embodiment of a process for removing catalyst fines and solubilized metals from an FT reactor effluent.

Referring to FIG. 1, a FT reactor product 101 from FT reactor(s) (not shown) is contacted with a chelating agent solution 102 in a mixer 110. The FT reactor product 101 includes about 1 wppm to about 100 wppm ultra-fine particulates. The ultra-fine particulates, in turn, include colloidal suspension and/or solubilized metals. Depending on the FT catalyst system in the slurry FT reactor (i.e. catalytic element, promoter, and support), the metals may include cobalt, iron, and other elements from Group VIII of the periodic table. Additionally, the solubilized metals and ultra-fine particulates may also include elements typically used as catalyst promoters and supports, including lanthanum, lithium, sodium, potassium, magnesium, calcium, barium, cesium, thorium, chromium, molybdenum, tungsten, manganese, rhenium, boron, carbon, silicon, zinc, titanium, zirconium, and aluminum.

Chelating agents are well known to those skilled in the art and a short list of classifications is provided as follows: phosphates (e.g. sodium tripolyphosphate), phosphoric acids (e.g. hydroxyethylenephosphoric acid), aminocarboxylic acids (e.g. EDTA), diketones (e.g. acetylacetone), organic acids (e.g. tartaric, citric, or oxalic acid), polyamines (e.g. diethylenetriamine), aminoalcohols (e.g. triethanolamine). In one embodiment, the chelating agent solution 102 is a solution of citric acid or ethylene diamine tetraacetic acid (EDTA). The concentration of the chelating agent in the solution 102 is about 2 wt % to about 90 wt %, in another embodiment, about 35 wt % to about 75 wt %. In one embodiment, a solvent for preparation of the chelating agent solution is water, although carriers such as, glycols, and alcohols or combinations thereof are also used in various embodiments.

The mixer 110 provides for intimate contact of the chelating agent with the solubilized metals in the FT product, such that metal complex(es) or coordination compound(s) comprising the metal(s) and the chelating agent is formed. Suitable devices for use as the mixer include continuous stirred tanks with providing residence time for formation of the metal complex(es). It should be recognized by those skilled in the art that other devices or combinations, such as a static mixer or a high shear mixer with an optional residence tank, also achieve the desired conditions for metal complex formation. Similarly, it should be further recognized by skilled artisans that organic compounds other than citric acid or EDTA, or combinations thereof, may be used to form metal complexes or coordination compounds, and thus suitable for use in preparing chelating agent solution 102.

A FT product stream containing metal complex(es), stream 112, is then directed to a centrifugal separator 120. Optionally, a water stream 114 is introduced to form a centrifugal separator feed 116. The centrifugal separator 116 thus includes the FT product, metal complex(es), as well as free, emulsified, and dissolved water. In one embodiment, the centrifugal separator 120 is a stacked disk centrifuge such as those disclosed in U.S. Pat. Nos. 4,698,053 and 5,518,494, and presently fabricated and supplied by companies such as Westfalia and Alfa-Laval. The centrifuge 120 separates the feed 116 into a heavy phase 122 including water and metal complex(es), and a light phase 124 including the FT product. The light phase 124 is thus substantially free of solubilized metals, having less than 500 wppb, in another embodiment, less than 300 wppb, and in another embodiment, less than 100 wppb solubilized metals.

Figure 2:
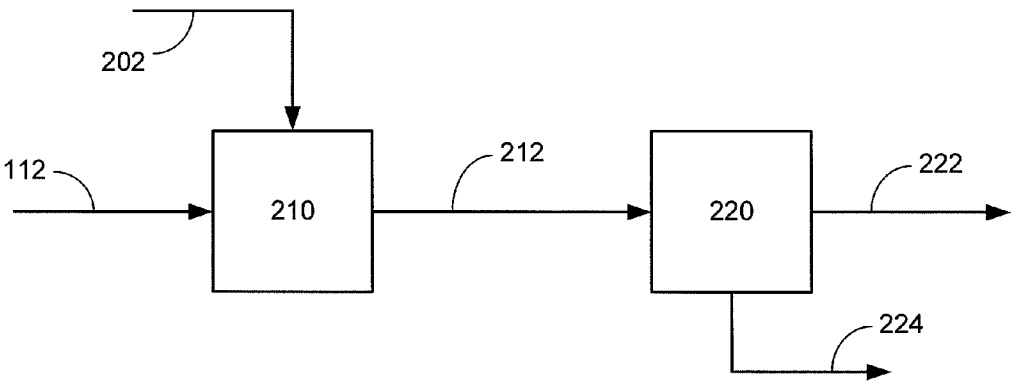
FIG. 2 is a schematic flow diagram of an alternate embodiment of the process for removing catalyst fines and solubilized metals from the FT reactor effluent.

In the alternate embodiment of FIG. 2, a FT product stream containing metal complex(es), stream 112 (as described in the FIG. 1 embodiment), is directed to a solids powder mixing device 210. A filter media 202 is introduced to the mixing device 210 wherein it comes into contact with the FT product stream 112 containing metal complex(es). In one embodiment, the filter media 202 is a natural or synthetic silica, or magnesium silicate clay, in the powder form. The powder media typically has a particle size distribution in the 1-100 micron range. Examples of filter media 202 include perlites, diatomaceous earth, bleaching earths, synthetic silica hydrogels (e.g. Trisyl® from W. R. Grace), cellulosic derivatives, or combinations thereof. Many of these media have been used in the industry for color removal ("bleaching") and/or as filter aids.

The filter media 202 may be fed in powder form, or pumped as a slurry into mixing device 210. In one embodiment, slurries are pumped from an adsorbent slurry tank (not shown), wherein a slurry containing up to 10 wt % adsorbent media is prepared. In one embodiment, for feeding the solid adsorbent media directly into the mixing device 210, screw feeders or loss-in-weight screw feeder/load cell combinations are also used. However, it should be understood that any device utilized for feeding a media may be used in accordance with the present disclosure as described herein. One mixing device 210 is a continuous flow stirred tank vessel equipped with an agitator. Some embodiments provide direct steam injection in addition to, or instead of mechanical agitation, to provide heating and/or further agitation. Any vessel/internal combination that promotes contacting between for absorption/adsorption of metal complex(es) onto the filter media is suitable for use as mixing device 210. The filter media 202 and the mixing device 210 can also affect adsorption of polar compounds present in the FT product (e.g. carboxylic acids) to the filter media.

A product stream 212 containing solubilized metal complexes and filter media 202 is directed to a filtration unit 220 for separation of the solubilized metal complexes as a solids cake 224 to provide a treated FT product stream 222 substantially free of solubilized metals and ultra-fine particulates.

A variety of filtration devices is represented by a filtration unit 220. Examples of such devices are rotary drum filters, belt filters, bag filters, pressure leaf filters. In other embodiments, a plurality of filtration units may be utilized so long as the plurality of filtration units functions in accordance with at least one embodiment of the present invention as described herein. In one embodiment, the filtration unit 220 is a horizontal or vertical pressure leaf filter. In one embodiment, the pressure leaf filter is pre-coated with a filter aid such as diatomaceous earth. As such, the FT product flows through a cake of filter media as it is pressured through the leaf filter. It should be understood by one of ordinary skill in the art that filtration is a mature industry and those skilled in the art can configure various units to achieve the required separation as described herein.

The treated FT product stream 222 has less than 500 wppb, in another embodiment, less than 300 wppb, and in some embodiments, less than 100 wppb solubilized metals. Furthermore, since the filter media removes undesirable polar compounds such as carboxylic acids, the treated FT product stream 222 may optionally be fractionated into fuel cuts without hydroprocessing. In one embodiment, at least 30% of the carboxylic acids are removed from the FT reactor product. In another embodiment, at least 60% of the carboxylic acids are removed from the FT reactor product. When subjected to hydroprocessing (e.g. for olefin saturation, hydrocracking, paraffin isomerization and/or other deoxygenation reactions, such as hydrodeoxygenation and hydrodenitrogenation) due to the substantial reduction of metals and other contaminants, the treated FT product achieves superior reactor run performance (i.e. longer run lengths and better stability of activity/selectivity). Additional benefits include, but are not limited to a reduction in hydroprocessing, fixed bed reactor guard bed size (i.e. either building a smaller reactor or substituting active catalyst for guard bed material); the ability to select lower cost alloys in the materials of construction; extended run times between catalyst changes.

Figure 3:
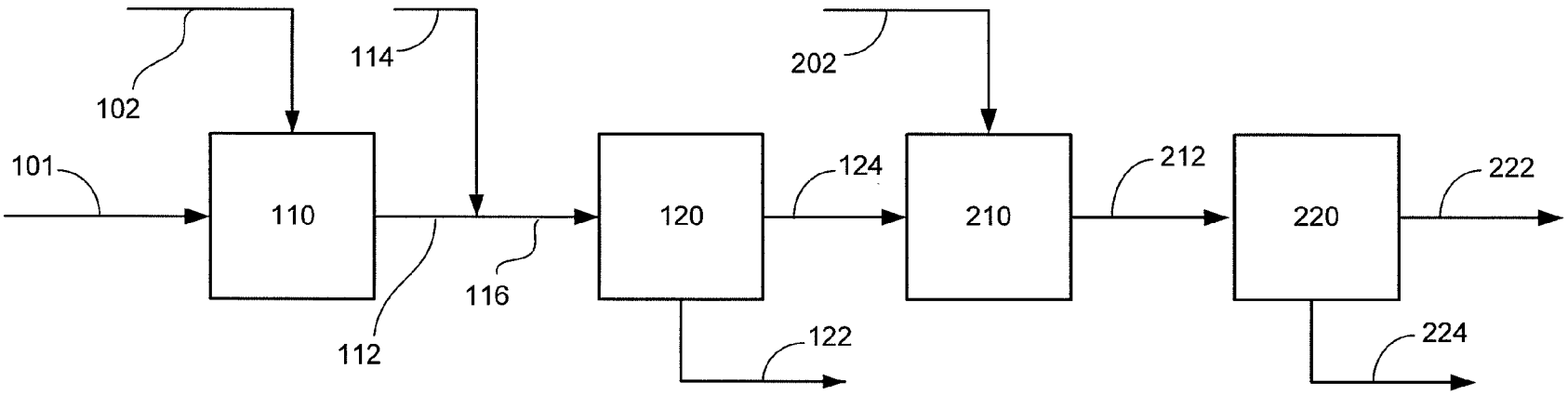
FIG. 3 is a schematic flow diagram of yet another embodiment of the process for removing catalyst fines and solubilized metals from the FT reactor effluent.

In another alternate embodiment, shown in FIG. 3, the FT product 101 is subjected to the treatment process of FIG. 1 and FIG. 2 in series. Referring to FIG. 3, the light phase 124 from the centrifuge 120, as described in the FIG. 1 embodiment, is directed to a mixing device 210 and a filtration unit 220, as described in the FIG. 2 embodiment. (The reference markers for FIG. 3 have been described in the FIG. 2 embodiment.) Since the FT product in this embodiment has been subjected to two different mechanisms for removal of the formed metal complex(es), namely, centrifugal separation and filtration through adsorption media, the final concentration of residual solubilized metals in the treated FT product stream 222 is less than 500 wppb, in another embodiment, less than 300 wppb, and in one embodiment, less than 100 wppb.

Many modifications of the exemplary embodiments of the disclosure disclosed above will readily occur to those skilled in the art. Accordingly, the disclosure is to be construed as including all structure and methods that fall within the scope of the appended claims.

What is claimed:

1. A method of removing solubilized metals from a Fischer-Tropsch (FT) reactor product, comprising:
- contacting the FT reactor product with a chelating agent solution to form metal complex(es); and
- subjecting the FT product containing the metal complex(es) to centrifugal separation to form a heavy phase and a light phase containing less than 500 wppb solubilized metals;
- wherein
  - the chelating agent solution comprises a chelating agent and a solvent; and
  - the solvent comprises a glycol, an alcohol, or combinations thereof.

2. The method of claim 1 wherein the light phase is contacted with adsorbent media and/or filtration aids and filtered through a pressure leaf filter to provide a treated FT product.

3. The method of claim 2 wherein the treated FT product contains less than 300 wppb solubilized metals.

4. The method of claim 2 wherein
- the FT reactor product comprises carboxylic acids; and
- the method removes at least 30% of the carboxylic acids in providing the treated FT product.

5. The method of claim 4 wherein the method removes at least 60% of the carboxylic acids in providing the treated FT product.

6. The method of claim 2 further comprising either fractionating the treated FT product into fuel cuts without hydroprocessing, or hydroprocessing the treated FT product or fractions thereof.

7. The method of claim 6 wherein the hydroprocessing step saturates olefins.

8. The method of claim 6 wherein the hydroprocessing step isomerizes paraffins.

9. The method of claim 1 wherein the chelating agent comprises citric acid.

10. The method of claim 1 wherein the centrifugal separation is conducted in a stacked disc centrifuge.

11. The method of claim 1 wherein additional water is provided for the centrifugal separation step.

12. The method of claim 1 wherein the solubilized metals comprise cobalt or iron.

13. The method of claim 12 wherein the solubilized metals additionally comprise titanium or lanthanum.

14. The method of claim 1 wherein the contacting comprises high-shear mixing.

15. The method of claim 1 wherein the contacting comprises static mixing.

16. The method of claim 1 wherein the chelating agent comprises sodium tripolyphosphate, hydroxyethylenephosphoric acid, ethylene diamine tetraacetic acid, acetylacetone, tartaric acid, citric acid, oxalic acid, diethylenetriamine, triethanolamine, or combinations of any two or more thereof.

17. A method of removing solubilized metals from a Fischer-Tropsch (FT) reactor product, comprising:
- contacting the FT reactor product with a chelating agent solution to form metal complex(es); and
- contacting the FT product containing the metal complex(es) with absorbent and/or adsorbent media and/or filtration aids and filtering to provide a treated FT product containing less than 500 wppb solubilized metals;
- wherein
  - the chelating agent solution comprises a chelating agent and a solvent; and
  - the solvent comprises a glycol, an alcohol, or combinations thereof.

18. The method of claim 17 wherein the chelating agent comprises citric acid.

19. The method of claim 17 wherein the treated FT product contains less than 300 wppb solubilized metals.

20. The method of claim 17 wherein
- the FT reactor product comprises carboxylic acids; and
- the method removes at least 30% of the carboxylic acids in providing the treated FT product.

21. The method of claim 20 wherein the method removes at least 60% of the carboxylic acids in providing the treated FT product.

22. The method of claim 17 further comprising either fractionating the treated FT product into fuel cuts without hydroprocessing, or hydroprocessing the treated FT product or fractions thereof.

23. The method of claim 22 wherein the hydroprocessing step saturates olefins.

24. The method of claim 22 wherein the hydroprocessing step isomerizes paraffins.

25. The method of claim 17 wherein the solubilized metals comprise cobalt or iron.

26. The method of claim 25 wherein the solubilized metals additionally comprise titanium or lanthanum.

27. A method comprising:

contacting a Fischer-Tropsch (FT) reactor product with a chelating agent solution to form metal complex(es); and subjecting the FT product containing the metal complex(es) to centrifugal separation to form a heavy phase and a light phase;

wherein the chelating agent solution comprises a chelating agent and a solvent;

the concentration of the chelating agent in the chelating agent solution is about 35 wt % to about 75 wt %; and the solvent comprises a glycol, an alcohol, or combinations thereof.

28. The method of claim 27 wherein the chelating agent comprises citric acid.

* * * * *